US009186919B2

(12) United States Patent
Ishizuka

(10) Patent No.: US 9,186,919 B2
(45) Date of Patent: Nov. 17, 2015

(54) LIQUID DISCHARGE DEVICE AND MEDIA REEL-OUT METHOD

(71) Applicant: SEIKO EPSON CORPORATION, Tokyo (JP)

(72) Inventor: Hirotaka Ishizuka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/600,499

(22) Filed: Jan. 20, 2015

(65) Prior Publication Data

US 2015/0231902 A1 Aug. 20, 2015

(30) Foreign Application Priority Data

Feb. 14, 2014 (JP) ..... 2014-026320

(51) Int. Cl.

| | |
|---|---|
| ***B41J 29/38*** | (2006.01) |
| ***B41J 13/00*** | (2006.01) |
| ***B41J 11/42*** | (2006.01) |
| ***B41J 29/393*** | (2006.01) |
| *B41J 11/00* | (2006.01) |

(52) U.S. Cl.

CPC ..... *B41J 13/0009* (2013.01); *B41J 11/42* (2013.01); *B41J 29/393* (2013.01); *B41J 11/0095* (2013.01); *B41J 13/00* (2013.01)

(58) Field of Classification Search

None

See application file for complete search history.

(56) References Cited

U.S. PATENT DOCUMENTS

2013/0257943 A1* 10/2013 Toya et al. ..... 347/9

FOREIGN PATENT DOCUMENTS

| | | | |
|---|---|---|---|
| JP | 03-045774 | A | 2/1991 |
| JP | 2000-289274 | A | 10/2000 |
| JP | 2003-003365 | A | 1/2003 |

OTHER PUBLICATIONS

Yamamoto, Nobuya et al., Apparatus for printing fabric, Jan. 8, 2003, J-Plat Pat Machine Translation, Paragraphs 0013-0035.*

* cited by examiner

*Primary Examiner* — Lisa M Solomon

(74) *Attorney, Agent, or Firm* — Global IP Counselors, LLP

(57) ABSTRACT

A liquid discharge device includes a media reel-out unit for reeling media out, a reel-out volume adjustment unit for adjusting the reel-out volume of the media from the media reel-out unit based on change in the slack volume of the media at a position downstream from the media reel-out unit, a first sensor arranged at a position facing at least one edge part in the media width direction, and a second sensor spaced apart from the first sensor in the media width direction. Both the media slack volume and the presence or absence of meandering of the media can be ascertained using sensing information of the first sensor and the second sensor.

11 Claims, 10 Drawing Sheets

LIQUID DISCHARGE DEVICE AND MEDIA REEL-OUT METHOD

CROSS-REFERENCE TO RELATED APPLICATIONS

This application claims priority to Japanese Patent Application No. 2014-026320 filed on Feb. 14, 2014. The entire disclosure of Japanese Patent Application No. 2014-026320 is hereby incorporated herein by reference.

BACKGROUND

1. Technical Field

The present invention relates to a liquid discharge device equipped with a media reel-out unit for reeling out media rolled into roll form, and a reel-out volume adjustment unit that adjusts the reel-out volume of the media reeled out from the media reel-out unit based on changes in the slack volume of the media at a media slack state part produced at a downstream position of the media reel-out unit, and to a media reel-out method.

2. Related Art

As devices that perform printing on fabric such as cotton, silk, polyester or the like, from the past, screen printing devices and roller printing devices for which each color plate is prepared for each pattern to be printed have been widely used. Also, in recent years, in response to digitalization, since it is possible to print on fabric without plates, inkjet printing device that are able to handle production of a wide variety of items in small volume are rapidly becoming popular.

This kind of inkjet printing device is provided with various sensors considering characteristics of fabric such as that it has greater elasticity than paper and thus can have meandering and wrinkles occur more easily. For example, with Japanese Unexamined Patent Publication No. 2003-3365, to correct the aspect ratio of an image to be printed considering the elasticity of the media, a sensor is provided to detect the stretching volume of the media.

Also, with Japanese Unexamined Patent Publication No. 2000-289274, to make it possible to do automatic printing on a long medium, a sensor is provided to detect the reel-out end edge of the media.

Also, provided are a meandering sensor for preventing in advance conveyance failure due to meandering of the media, or a slack sensor for keeping the media slack volume in a suitable range to match the properties of the media, without applying tension to the media. Of the sensors noted above, the slack sensor and the meandering sensor are the sensors that are directly linked to printing quality.

SUMMARY

However, in the past, this slack sensor and meandering sensor were provided individually as respectively independent dedicated sensors. Because of that, there was the problem that the number of parts increased by respectively providing each individual sensor separately, bringing on increased assembly costs and production costs.

An object of the present invention is to realize maintaining of a suitable slack volume and suppression of meandering of the media during conveying of the media, while reducing the number of sensors that are required.

A liquid discharge device according to first aspect includes a media reel-out unit, a reel-out volume adjustment unit, a first sensor and a second sensor. The media reel-out unit is configured and arranged to reel out media. The reel-out volume adjustment unit is configured and arranged to adjust a reel-out volume of the media reeled out from the media reel-out unit based on change in a slack volume of the media at a position downstream from the media reel-out unit. The first sensor is arranged at a position facing at least one edge part in a media width direction of the media. The second sensor is arranged spaced apart from the first sensor in the media width direction. The slack volume of the media is ascertained using sensing information of the first sensor, and presence or absence of meandering of the media is ascertained using sensing information of the first sensor and the second sensor.

With this aspect, it is possible to ascertain the presence or absence of both the slack volume of the media and the presence or absence of meandering of the media using the sensing information of the sensor pair that has the first sensor and the second sensor as constitutional elements. Specifically, in addition to the role as the slack sensor, the first sensor can also fulfill the role as the meandering sensor by being a part of the sensor pair. By doing this, it is possible to realize maintaining of a suitable slack volume and suppression of meandering of the media during conveying of the media, while reducing the number of sensors that are required.

The liquid discharge device of the second aspect is that of the first aspect wherein the media reel-out volume is preferably adjusted based on the slack volume, and a meandering countermeasure process is preferably executed based on the meandering information indicative of presence of meandering.

Here, the "meandering countermeasure process" includes, when meandering is "present," either or both of a process of reporting that to the user using sound, light, or making a display to that effect on a display unit, and a process of automatically correcting the meandering.

With this aspect, the reel-out volume of the media is adjusted based on the slack volume obtained using the sensing information of the sensor pair, and furthermore, a meandering countermeasure process is executed based on the meandering information indicative of presence of meandering, so it is possible to effectively obtain the effects of the first aspect.

The liquid discharge device of the third aspect is that of the first aspect or second aspect wherein the first sensor is preferably arranged at a position facing the one edge part in the media width direction of the media, and the second sensor is preferably arranged at an outside of the one edge part in the media width direction of the media.

With this aspect, the first sensor and the second sensor are arranged so as to extend across one side in the width direction of the media in a slack state, so it is possible to measure the slack volume of the media by using the first sensor arranged on the inside of that side as the slack sensor.

Also, it is possible to ascertain the presence or absence of meandering of the media and the direction of the meandering by using the first sensor and the second sensor pair as the meandering sensor.

The liquid discharge device of the fourth aspect is that of the first aspect or the second aspect wherein the first sensor is preferably arranged at a position facing the one edge part in the media width direction of the media, and the second sensor is preferably arranged at a position facing the other edge part in the media width direction of the media.

With this aspect, the first sensor and the second sensor are arranged on the inside of one side and on the inside of the other side in the width direction of the media in the slack state, so it is possible to use both the first sensor and the second sensor as the slack sensor. By doing this, it is possible to measure the slack volume at both ends in the width direction of the media, and possible to ascertain variation of the slack volume in the width direction of the media by comparing both values.

Also, by using the first sensor and the second sensor pair as the meandering sensor, it is possible to ascertain the presence or absence of meandering of the media, and the direction of the meandering.

The liquid discharge device of the fifth aspect is that of the third aspect wherein the first sensor and the second sensor are preferably arranged at positions skewed in a media reel-out direction.

With this aspect, when using the first sensor and the second sensor as the meandering sensor, a determination is made of the media meandering presence or absence and the meandering direction at positions of two points skewed in the reel-out direction of the media. Therefore, handling is easy even when there are restrictions on the sensor arrangement location.

Also, if one sensor of the sensor pair is arranged as the meandering sensor at the upstream side in the media conveyance direction, it is possible to ascertain the presence or absence of meandering at an earlier timing, and to start the meandering countermeasure process at an earlier timing.

The liquid discharge device of the sixth aspect is that of the fourth aspect wherein the first sensor and the second sensor are preferably arranged at positions skewed in a media reel-out direction.

With this aspect, when using the first sensor and the second sensor as the slack sensor, measurement of the slack volume of the media is performed at positions of two points skewed in both directions including the media width direction and the reel-out direction. Therefore, the measurement precision of the media slack volume is improved by comparing the measurement values of the positions at two points.

Also, when using the first sensor and the second sensor as the meandering sensor, it is possible to perform ascertaining of the media meandering presence or absence and the meandering direction using the measurement values of the positions of two points skewed in both directions including the media width direction and reel-out direction.

The liquid discharge device of the seventh aspect is that of any of the first through sixth aspects, wherein positions of the first sensor and the second sensor are preferably variable in the media width direction according to a media width dimension.

With this aspect, it is possible to adjust the position of the first sensor and the second sensor according to the width dimension of the media used, so it is possible to perform maintaining of a suitable slack volume and suppression of meandering of the media during conveying of the media for various types of media with different width dimensions.

Also, if made possible to move the first sensor and the second sensor independently by separating them away from the media reel-out unit, it is possible to provide the first sensor and the second sensor at appropriate positions without considering the media reel-out unit constitution or the positional relationship.

The liquid discharge device of the eighth aspect is that of the seventh aspect wherein the first sensor and the second sensor preferably move in the media width direction in coordination with a position of a movable holder of the media reel-out unit.

With this aspect, by executing position adjustment of the width direction of the movable holder performed to match the media to the width dimension of the media when setting it in the media reel-out unit, the positions of the first sensor and the second sensor are automatically adjusted to suitable positions, so the position adjustment work is easy.

The liquid discharge device of the ninth aspect is that of the third aspect or the fifth aspect, preferably equipped with a control unit that performs the following determinations (1) to (3) based on the sensing information of the first sensor and the second sensor, (1) determination that when both the first sensor and the second sensor are in an On state, there is meandering to one side by the media (2) determination that when both the first sensor and the second sensor are in an Off state, there is meandering to the other side by the media, or (3) determination that when the first sensor is in the On state and the second sensor is in the Off state, proper reel-out of the media is executed.

With this aspect, it is possible to ascertain the presence or absence of media meandering and the meandering direction simply by combining the three On state and Off state aspects of the first sensor and the second sensor arranged at one side in the width direction of the media in a slack state. Therefore, it is possible to easily and quickly perform the media meandering countermeasure process. Also, the sensors are acceptable as long as it is possible to determine the On state and Off state, so it is possible to use relatively inexpensive sensors.

The liquid discharge device of the tenth aspect is that of the fourth aspect or the sixth aspect, preferably equipped with a control unit that performs the following determinations (1) to (3) based on the sensing information of the first sensor and the second sensor, (1) determination that with the reel-out control unit, when the first sensor is in the On state and the second sensor is in the Off state, there is meandering to one side by the media (2) that when the first sensor is in an Off state and the second sensor is in an On state, there is meandering to the other side by the media, or (3) determination that when the first sensor and the second sensor are both in the On state, proper reel-out of the media is executed.

With this aspect, it is possible to determine the presence or absence of media meandering and the meandering direction simply by the three On state and Off state aspects of the first sensor and the second sensor arranged at both edge parts in the width direction of the media in a slack state. Therefore, suppression of media meandering is performed easily and quickly. Also, the sensors are acceptable as long as it is possible to determine the On state and Off state, so it is possible to use relatively inexpensive sensors.

A media reel-out method according to eleventh aspect is adapted to adjust a reel-out volume when reeling media out from a media reel-out unit based on change in a slack volume of the media. The media reel-out method includes: detecting the slack volume of the media by measuring a distance between the media and a first sensor using the first sensor arranged at a position facing at least one edge part in a media width direction of the media; and determining presence or absence of meandering of the media using the first sensor and a second sensor spaced apart from the first sensor in the media width direction.

With this aspect, it is possible to use one set of sensor pairs equipped with the first sensor and the second sensor arranged at designated positions to execute the measurement of the media slack volume and the determination of the presence or absence of media meandering, so it is possible to realize maintaining of a suitable slack volume and suppression of meandering of the media during conveying of the media, while reducing the number of sensors that are needed.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
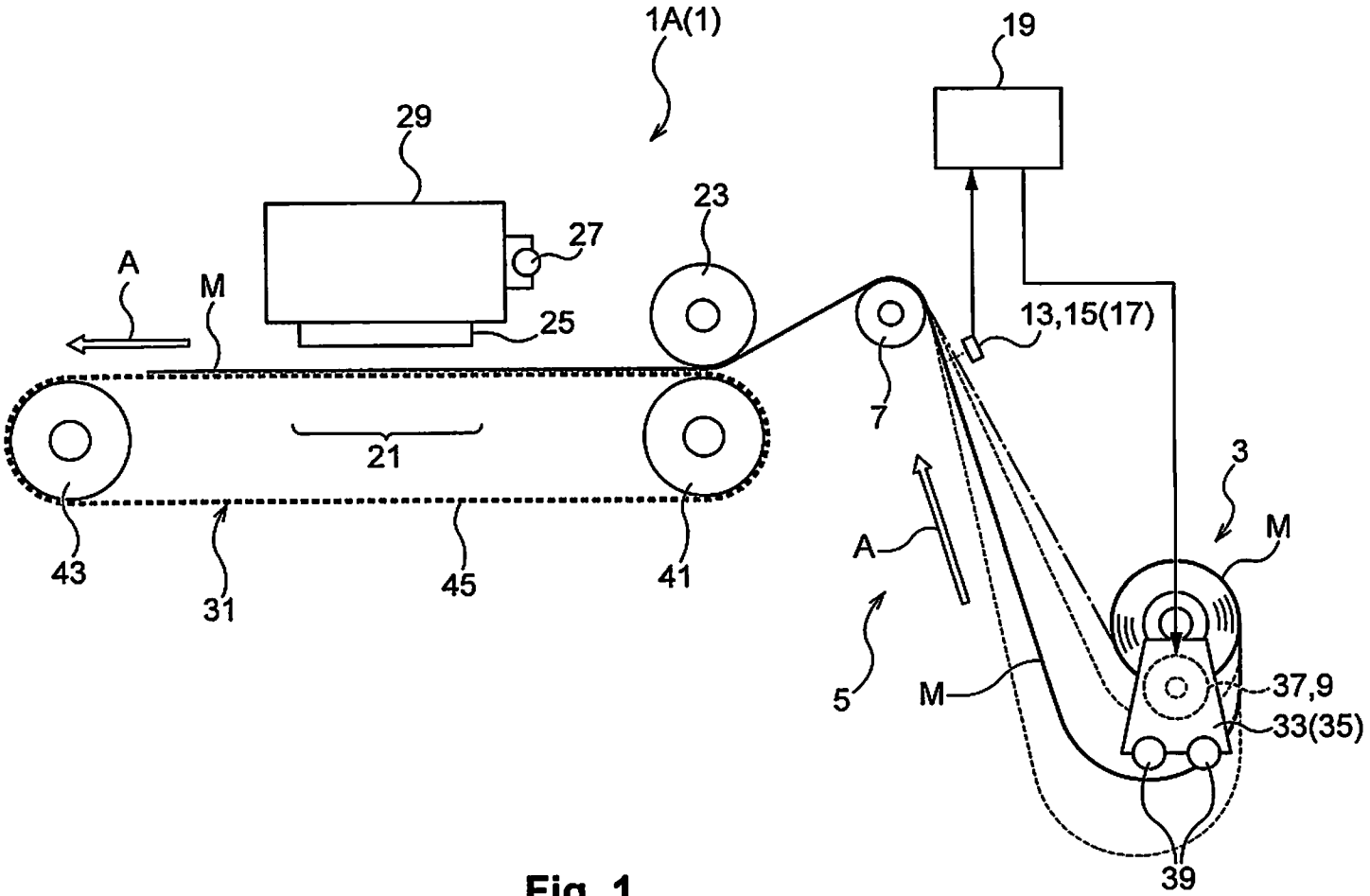
FIG. 1 is a schematic block diagram showing the liquid discharge device of embodiment 1 of the present invention.

Following, a detailed description is provided regarding the liquid discharge device and media reel-out method of the present invention while referring to the attached drawings.

With the description below, initially, a specific description is provided regarding the constitution and operating mode of the liquid discharge device of the present invention based on embodiments 1 through 6 shown in FIG. 1 through FIG. 8. Then, a specific description is provided regarding the media reel-out method of the present invention based on embodiment 7 shown in FIG. 9 and FIG. 10.

Embodiment 1

FIG. 1 Through FIG. 3C

The liquid discharge device 1A(1) of this embodiment is an inkjet printing device that uses fabric rolled into roll form as media M. Here, "fabric" is a textile product of natural fibers such as cotton, hemp, silk or the like, chemical fibers such as nylon, polyester or the like, or a fabric or textile using as a source thread an item for which these are mixed or the like.

(1) Schematic Constitution of the Liquid Charge Device (See FIG. 1 Through FIG. 3C)

The liquid discharge device 1A of this embodiment is basically constituted by being equipped with a media reel-out unit 3 that reels out media M rolled into roll form, and a reel-out volume adjustment unit 9 that adjusts the reel-out volume of the media M reeled out from the media reel-out unit 3 based on changes in a slack volume W of the media M with a media slack state part 5 produced at a position downstream from the media reel-out unit 3.

There are provided a first sensor 13 (see FIG. 3C) arranged at a position facing at least one edge part 11A in a width direction B of the media M, and a sensor pair 17 which is the sensor pair 17 arranged separated in the width direction B of the media M wherein that pair is equipped with the first sensor 13 as one item and equipped with a second sensor 51 as the other item. Then, the constitution is such that it is possible to ascertain both the slack volume W of the media M and the presence or absence of meandering of the media M using the sensing information of the sensor pair 17.

The media M reeled out from the media reel-out unit 3 has a slack state formed with a first guide roller existing at a position downstream from the media reel-out unit 3. Specifically, the noted media slack state part 5 is produced at the position downstream from the media reel-out unit 3.

The sensing information detected by the sensor pair 17, specifically, each information of the slack volume W of the media M and the presence or absence of meandering of the media M are input to the control unit 19. The control unit 19 adjusts the reel-out volume of the media by the reel-out volume adjustment unit 9 based on the slack volume W information of the media M, and maintains a suitable volume of the slack volume W for the media slack state part 5. It also executes the meandering countermeasure process described later based on the presence or absence information of the meandering of the media M.

Also, in addition to the media reel-out unit 3, the reel-out volume adjustment unit 9, and the first guide roller 7 described previously, provided on this liquid discharge device 1A are a pressure roller 23 for supplying to a liquid discharge area 21 the media M for which the reel-out volume has been adjusted, a liquid discharge head 25 for spraying ink as an example of a liquid on a surface to be recorded of the media M supplied to the liquid discharge area 21 to execute recording, a carriage 29 that moves back and forth with the width direction B that crosses the feed direction A of the media M along the carriage guide shaft as the scan direction in a state with the liquid discharge head 25 as an example placed mounted on the bottom surface, and a media conveyance unit 31 for conveying the media M supplied to the liquid discharge area 21 in a feed direction A supported so as to not sag downward.

Figure 3A:
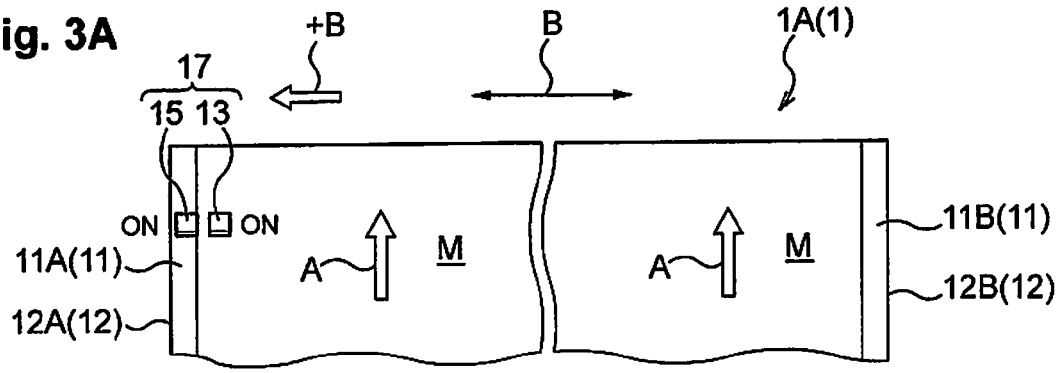
FIGS. 3A to 3C are front views showing the operating mode of the sensor pair of the liquid discharge device of embodiment 1 of the present invention.
Figure 3B:
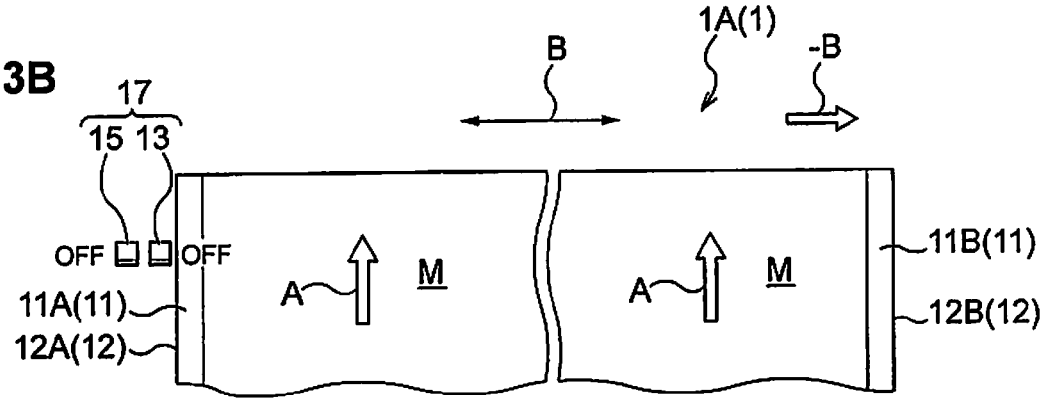
Figure 3C:
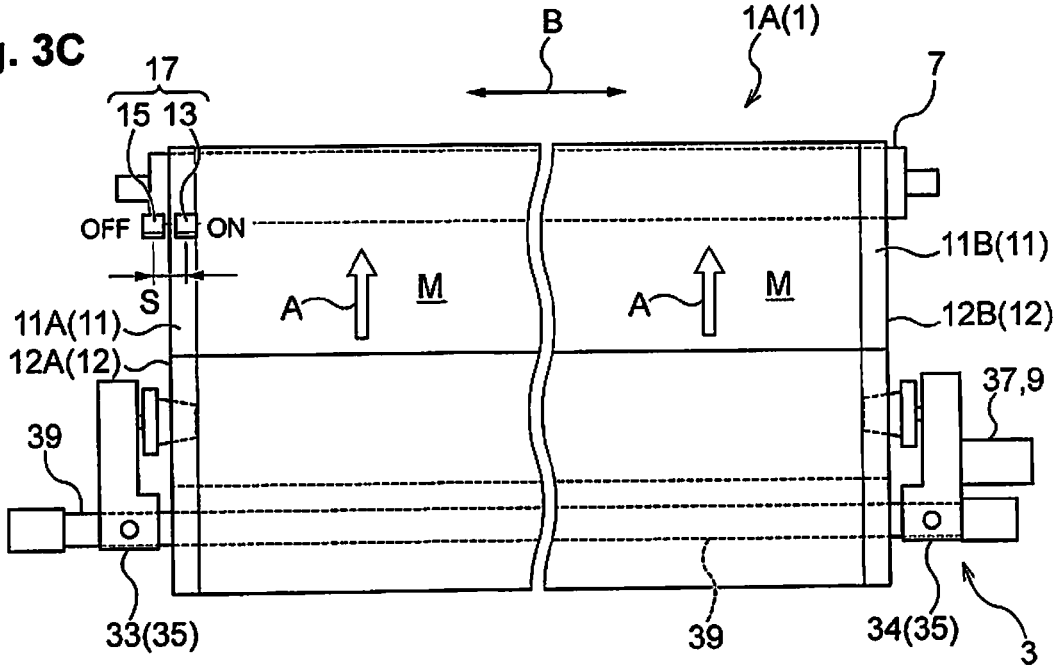

As shown in FIG. 3C, the media reel-out unit 3 is constituted so as to be equipped with a holder pair 35 that is a pair constituted with a movable holder 33 and a fixed holder 34 as an example that support the media M horizontally holding both ends of a core of the media M rolled into roll form, a reel-out motor 37 attached to the fixed holder 34 as an example, and a support rod which supports the movable holder 33 and the fixed holder 34 and also is a guide when moving the movable holder 33 in a width direction B.

As shown in FIG. 1, the media conveyance unit 31 is constituted by being equipped with a drive roller 41 provided at a position upstream from the feed direction A as an example, a driven roller 43 separated from the driver roller 41 and provided at a position downstream from the direction A as an example, and an adhesive belt 45 rolled onto the drive roller 41 and the driven roller 43.

When the media M reaches the media conveyance unit 31, it is led to the liquid discharge area 21 by the sandwiching feed operation by the pressure roller 23 and the drive roller 41 described previously that are under pressure contact by the drive roller 41. Then, the media M is conveyed in the feed direction A in a state adhered to the adhesive belt 45 so as not to have stretching or contraction.

(2) Constitution and Operating Mode of the Reel-Out Volume Adjustment Unit (FIG. 2 and FIGS. 3A to 3C)

Figure 2:
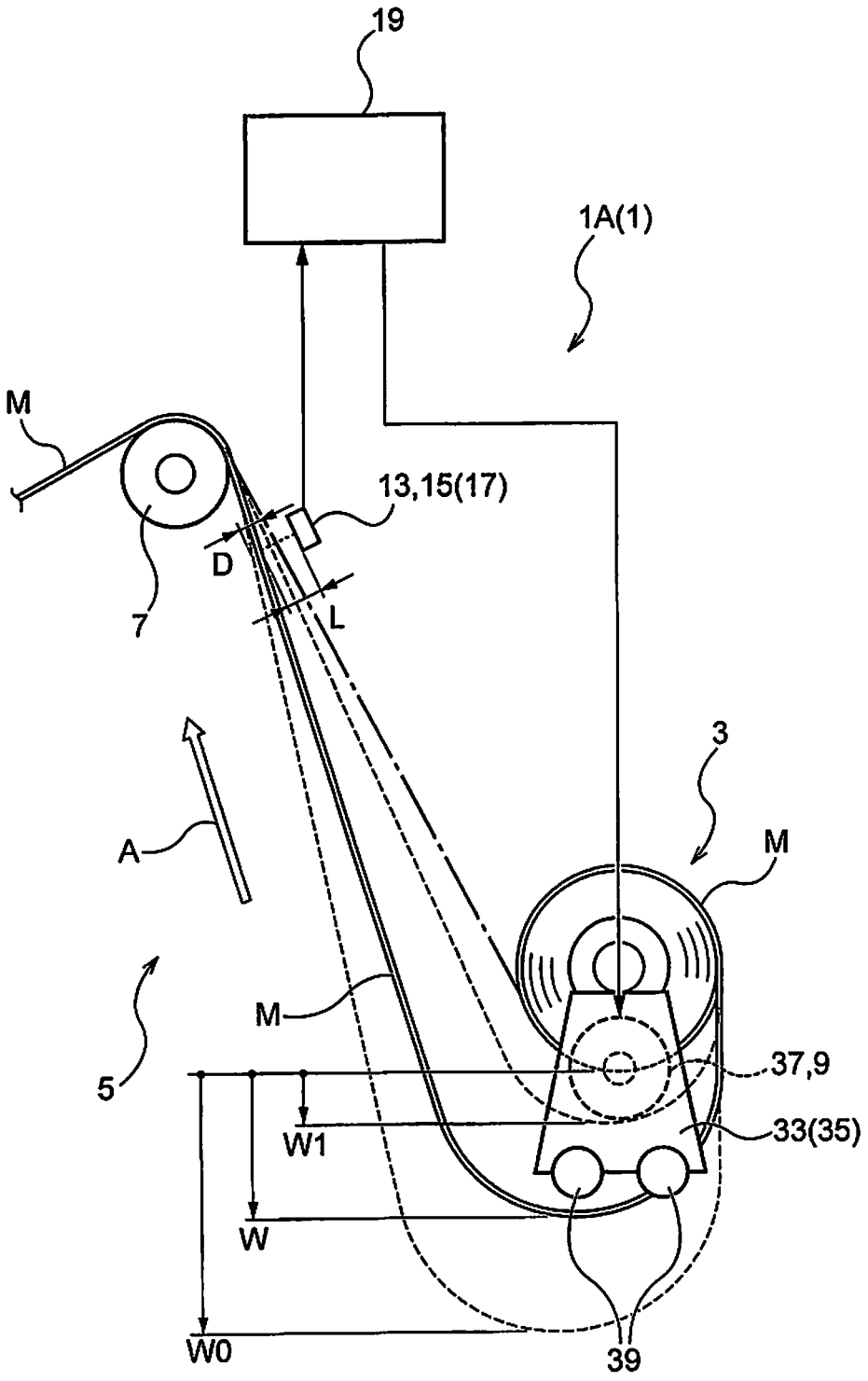
FIG. 2 is a side view shown with enlargement of the circumferential side of the reel-out volume adjustment unit of the liquid discharge device of embodiment 1 of the present invention.

The media slack state part 5 is produced with the object of the media M positioned between the media reel-out unit 3 and the first guide roller 7 not being in a state with tension applied as shown by the dot-dash line in FIG. 2, but rather to be kept with a slack state formed as shown by the solid line in FIG. 2.

With embodiment 1, the slack volume W of the media M is observed, and adjustment of the reel-out volume of the media M is performed so that the media M positioned between the media reel-out unit 3 and the first guide roller 7 is positioned within the slack state range shown by the dotted line in FIG. 2.

Incidentally, the reasons for changing and adjusting the reel-out volume of the media M are as follows. Specifically, when the reel-out volume of the media M is made constant, when the roll diameter of the media M is made large by a difference in the media M thickness or length and more than the necessary media M is reeled out, the vertical drop part of the media M contacts the floor surface and becomes dirty. On the other hand, when the roll diameter of the media M becomes small, the necessary volume of the media M cannot be reeled out, and tension is applied to the media M, and this becomes a cause of the media M expanding in the feed direction A or having wrinkles, lifting or the like occur. Therefore, with the goal of not having this kind of circumstance occur, the reel-out volume of the media M is made to be changed and adjusted.

The sensor pair 17 has only one set provided with this embodiment 1, and as shown in FIG. 3C, the first sensor 13 is arranged at a position facing one edge part 11A in the width direction B of the slack state media M. The second sensor 15 is arranged to the outside of the one edge part 11A in the width direction B of the slack state media M.

Specifically, as shown in FIG. 3C, during normal times when reel-out of the media M is performed normally, the constitution is such that one side 12A in the width direction B of the media M is sandwiched, and the second sensor 15 and the first sensor 13 are positioned at each side of that. A distance S between the second sensor 15 and the first sensor 13 is set to approximately 5 mm as an example.

Also, it is possible to apply a non-contact type optical sensor that does not contact the media M as an example of first sensor 13 and the second sensor 15. For the first sensor 13, as shown in FIG. 2, it is preferable to have a sensor having a function that can measure a distance L between the first sensor 13 and the media M. For the second sensor 15, it is sufficient as long as the sensor is an On and Off type for which it is possible to determine only the presence or absence of the media M.

Also, with this embodiment 1, the first sensor 13 is used as the slack sensor for measuring the slack volume W of the media M, and using the first sensor 13 and the second sensor 15 pair as the meandering sensor, the presence or absence of meandering of the media M and the direction of the meandering are ascertained.

The control unit 19 is in charge of the role of adjusting and controlling the reel-out volume of the media M based on the sensing information obtained from the first sensor 13 and the second sensor 15 described previously.

In specific terms, the slack volume W of the media M is found from the distance L information between the first sensor 13 and the media M measured by the first sensor 13, and the media M reel-out timing and reel-out volume are determined from the found media M slack volume W. The information determined here is sent to the reel-out motor 37, the reel-out motor 37 is driven, and reel-out of the media M is executed.

With FIG. 2, the suitable slack volume W range is shown as W0 to W1, and the media M movement range at the measurement location of the distance L by the first sensor 13 corresponding to that range is shown as a displacement volume D.

Also, to find the media M slack volume W using the distance L information, as shown by the dot-dash line in FIG. 2, it is necessary to tilt to a certain degree the conveyance path of the media M in a state with tension applied in the gravity direction, and typically, the greater this tilt (closer to horizontal), the greater the tendency for the value of the distance L to be in relation to the same slack volume W.

Conversely, when the tilt is zero, specifically, when the conveyance path is in the vertical direction, the distance L becomes constant without depending on the slack volume W, so since it is not possible to find the slack volume W even if the distance L is detected with the conveyance path in this way, it is desirable to have the conveyance path be at least tilted 10 degrees or more in relation to the vertical direction.

Also, as the meandering countermeasure process, based on the information of the presence or absence of meandering of the media M and the meandering direction sent from the first sensor 13 and the second sensor 15, with this embodiment, the control unit 19 determines continuing and stopping of reel-out of the media M, and switches between driving and stopping of the reel-out motor 37. Specifically, when meandering is "present," the process of notifying the user of that by voice or light, or by displaying that effect on the display unit or the like is executed.

In specific terms, when both the first sensor 13 and the second sensor 15 are in an On state as shown in FIG. 3A, it is determined that the media M is meandering to one side +B, and when both the first sensor 13 and the second sensor 15 are in an Off state as shown in FIG. 3B, it is determined that the media M is meandering to the other side −B, and driving of the reel-out motor 37 is stopped. Then, control is done so as to notify the user of the occurrence of meandering of the media M.

Also, when the first sensor 13 and the second sensor 15 are in an Off state as shown in FIG. 3C, it is determined that reel-out of the media M is being executed normally and control is performed so as to continue driving the reel-out motor 37.

As the meandering countermeasure process, separate from the process of reporting to the user when there is meandering "present" using voice, light, or a display to that effect on the display unit or the like, it is also possible to execute a process of correcting the meandering state automatically in addition to that reporting process.

Here, as the process of automatically correcting the meandering state, an example is a method whereby the constitution is made so that it is possible to change the angle of the first guide roller 7 in relation to the horizontal surface, and when meandering is "present," the angle is changed to the direction that cancels the meandering. Of course this is not limited to this method, and it is also possible to eliminate the meandering by moving the first guide roller 7 in the axis direction.

Then, with the liquid discharge device 1A of this embodiment 1 constituted in this way, it is possible to ascertain both the media M slack volume W and the presence or absence of the media M meandering using the sensing information of the sensor pair 17 that has as constitutional elements the first sensor 13 and the second sensor 15. Specifically, in addition to the role as the slack sensor, the first sensor 13 can also have the role of the meandering sensor by forming a portion of the sensor pair 17. By doing this, it is possible to realize maintaining of a suitable slack volume W and to suppress meandering of the media when conveying the media M while reducing the number of sensors that are needed.

Embodiment 2

Figure 4A:
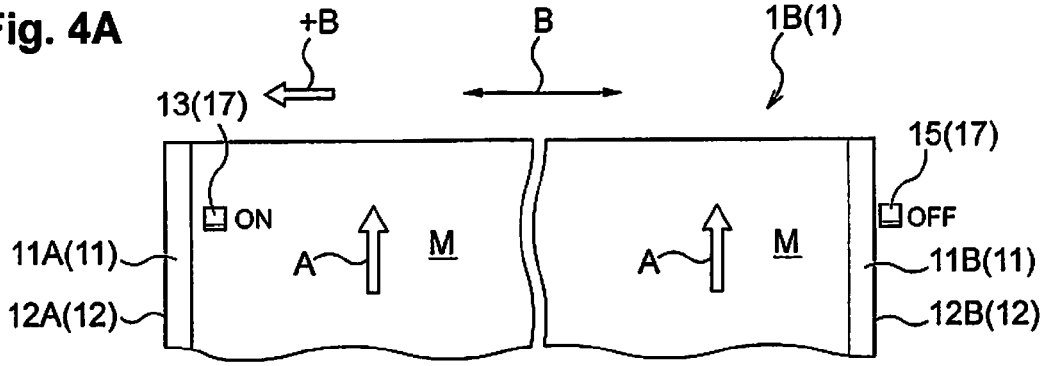
FIGS. 4A to 4C are front views showing the operating mode of the sensor pair of the liquid discharge device of embodiment 2 of the present invention.
Figure 4B:
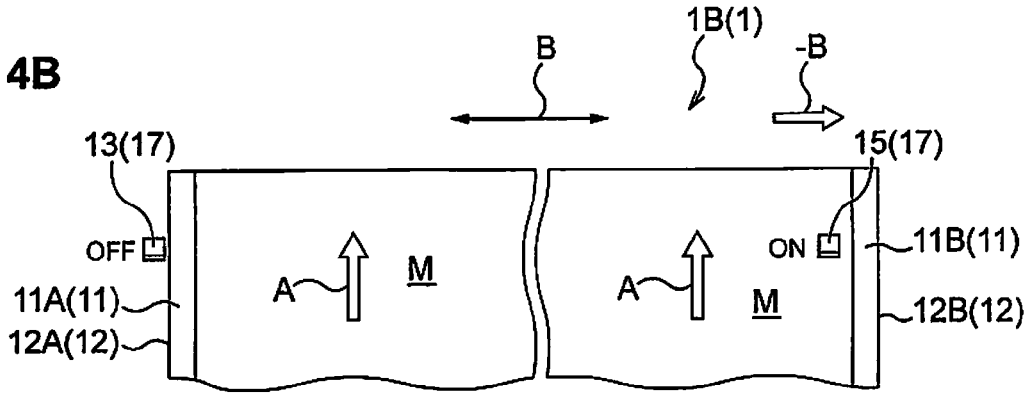
Figure 4C:
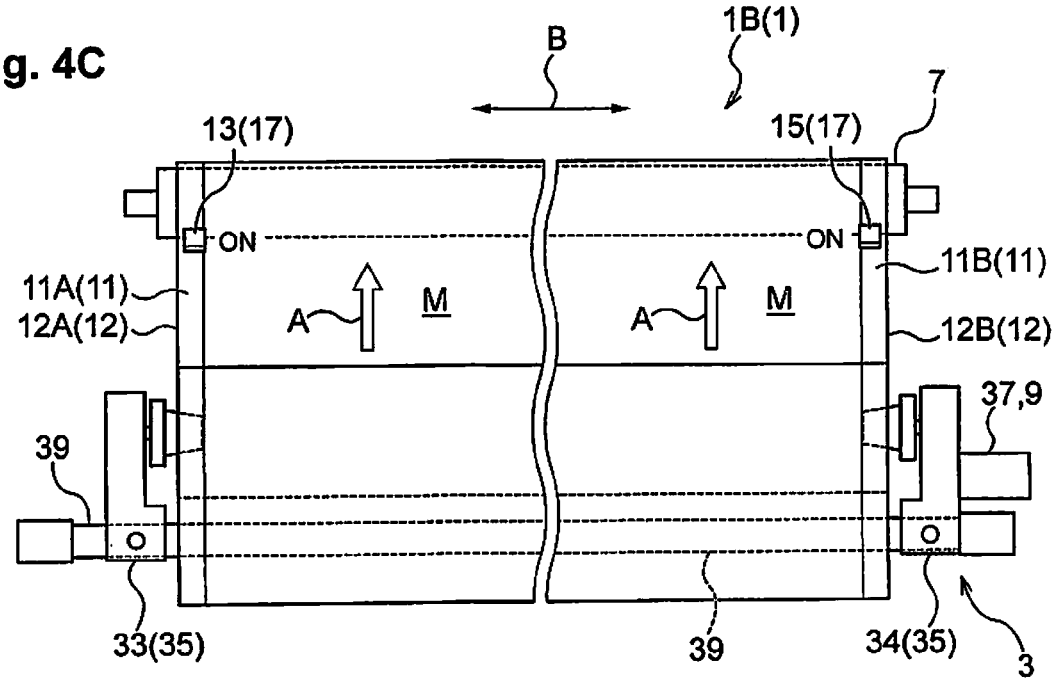

FIGS. 4A to 4C

The liquid discharge device 1B(1) of embodiment 2 is the same as the liquid discharge device 1A of embodiment 1 for the constitution other than the only difference which is the arrangement of the first sensor 13 and the second sensor 15, and the control contents with the control unit 19 accompanying this.

Therefore, here, a description of the same constitution as that of embodiment 1 will be omitted, and the description will be focused on the constitutions unique to embodiment 2.

Specifically, with this embodiment 2, the arrangement of the sensor pair 17 for which only one set is provided is different from embodiment 1, whereby the first sensor 13 is arranged at a position facing one edge part 11A in the width direction B of the slack state media M, and the second sensor 15 is arranged at a position facing the other edge part 11B in the width direction B of the slack state media M.

Specifically, during normal times when the media M reel-out is performed normally as shown in FIG. 4C, the constitution is such that the first sensor 13 and the second sensor 15 are respectively positioned at positions facing the edge parts 11A and 11B on the inside of both sides 12A and 12B of the width direction B of the media M.

Also, as the first sensor 13 and the second sensor 15, it is possible to use a non-contact optical sensor that does not contact the media M as an example, and it is preferable for both the first sensor 13 and the second sensor 15 to be sensors that have a function capable of measuring the distance L between the sensors 13 and 15 and the media M.

Incidentally, by working in this way, it is possible to use the first sensor 13 and the second sensor 15 for two types of applications as the slack sensor and the meandering sensor.

Then, the control unit 19 comprehensively determines the distance L information between the first sensor 13 and the media M measured by the first sensor, and the distance L information between the second sensor 15 and the media M measured by the second sensor 15 to find the slack volume W of the media M, and determines the media M reel-out timing and reel-out volume from the found media M slack volume W.

Also, when the first sensor 13 is in the On state and the second sensor 15 is in the Off state as shown in FIG. 4A, the control unit 19 determines that the media M is meandering to one side +B, and when the first sensor 13 is in the Off state and the second sensor is in the On state as shown in FIG. 4B, it determines that the media M is meandering to the other side −B and stops driving of the reel-out motor 37. Then, it performs control so as to report to the user the occurrence of meandering of the media M.

Also, when both the first sensor 13 and the second sensor 15 are in the On state, it is determined that the reel-out of that media M is being executed normally, and control is performed so as to continue driving of the reel-out motor 37.

Then, with the liquid discharge device 1B of this embodiment 2 constituted in this way as well, it is possible to enjoy the same operation and effects as those of the liquid discharge device 1A of embodiment 1 described previously.

Furthermore, with this embodiment 2, by using both the first sensor 13 and the second sensor 15 as slack sensors, it is possible to obtain the operation and effect of reducing the variation in the slack volume W in the width direction B of the media M.

Embodiment 3

Figure 5A:
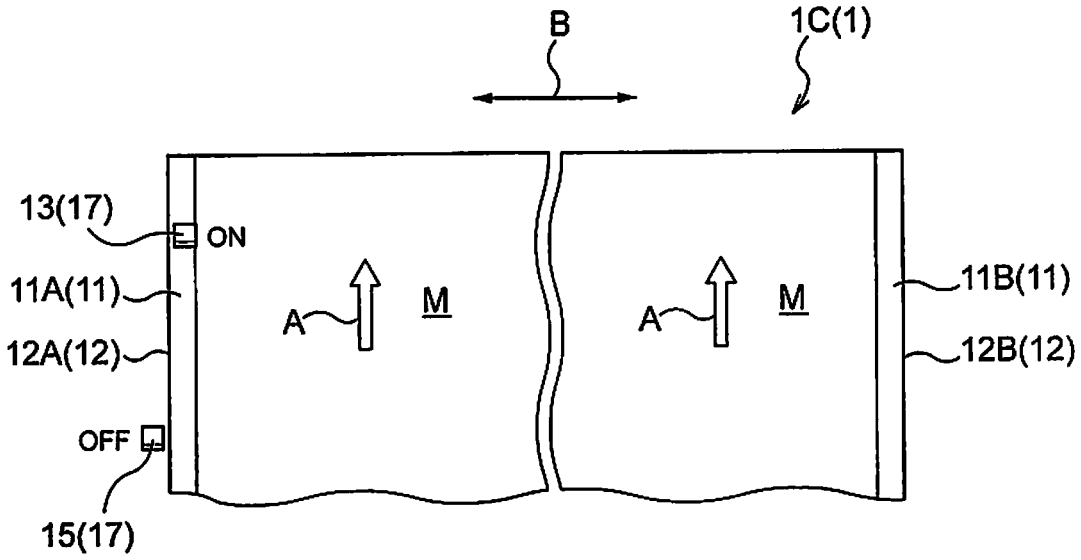
FIG. 5A is a front view and FIG. 5B is a side view showing the arrangement mode of the sensor pair of the liquid discharge device of embodiment 3 of the present invention.
Figure 5B:
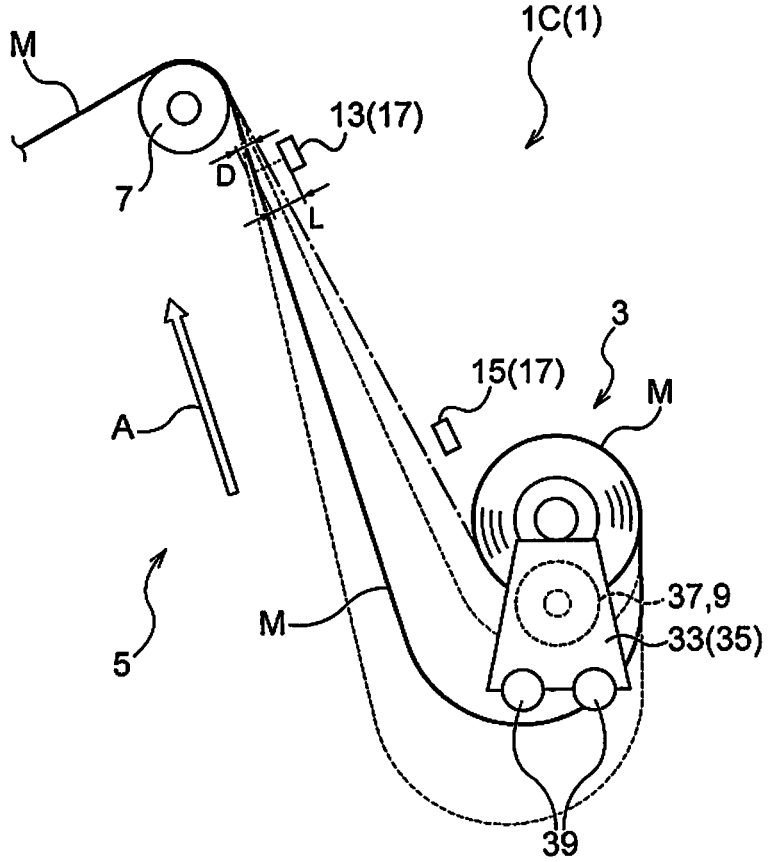

FIGS. 5A and 5B

The liquid discharge device 1C(1) of embodiment 3 is the same as the liquid discharge device 1A of embodiment 1 described previously for the constitution other than the only difference which is the arrangement of the second sensor 15.

Therefore, here, a description of the same constitution as that of embodiment 1 will be omitted, and the description will be focused on the constitutions unique to embodiment 3.

Specifically, with this embodiment 3, the arrangement of the sensor pair 17 for which only one set is provided is different from embodiment 1, whereby the first sensor 13 and the second sensor 15 are arranged at positions skewed in the reel-out direction A of the media M.

In specific terms, as shown in FIGS. 5A and 5B, an arrangement of the sensor pair 17 is used for which the second sensor 15 is positioned further to the upstream side toward the media reel-out unit 3 side than the position of the first sensor 13.

Then, with this liquid discharge device 1C of this embodiment 3 constituted in this way as well, it is possible to enjoy the same operation and effects as those of the liquid discharge device 1A of embodiment 1 described previously.

Furthermore, with this embodiment 3, when using the first sensor 13 and the second sensor 15 as meandering sensors, ascertaining of the presence or absence of meandering of the media M and the meandering direction is performed using positions at two points skewed in the reel-out direction A of the media M. Therefore, handling is easy even when there are restrictions on the sensor arrangement location.

Also, by arranging the second sensor 15 which is one sensor of the sensor pair 17 as the meandering sensor at the upstream side in the media conveying direction, it is possible to ascertain the presence or absence of meandering with earlier timing, and possible to start the meandering countermeasure process with earlier timing.

Embodiment 4

Figure 6A:
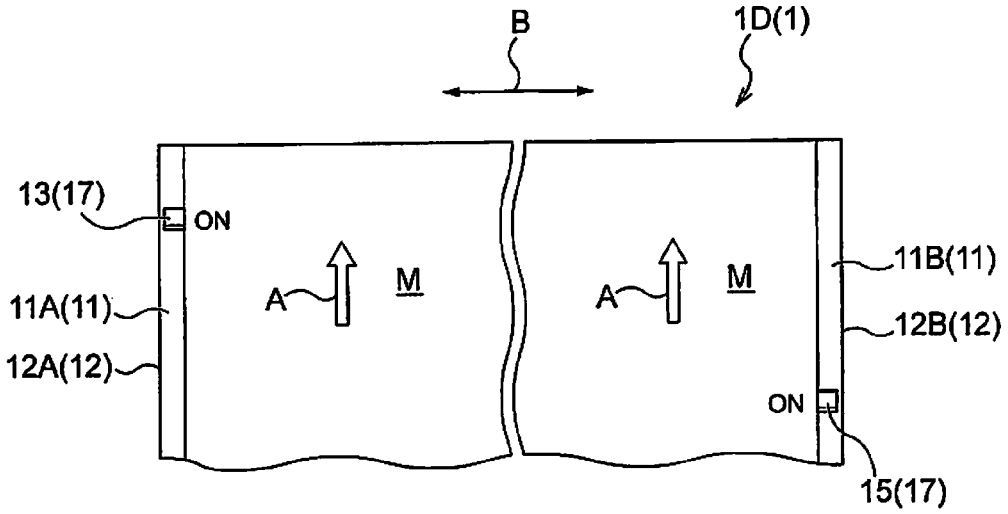
FIG. 6A is a front view and FIG. 6B is a side view showing the arrangement mode of the sensor pair of the liquid discharge device of embodiment 4 of the present invention.
Figure 6B:
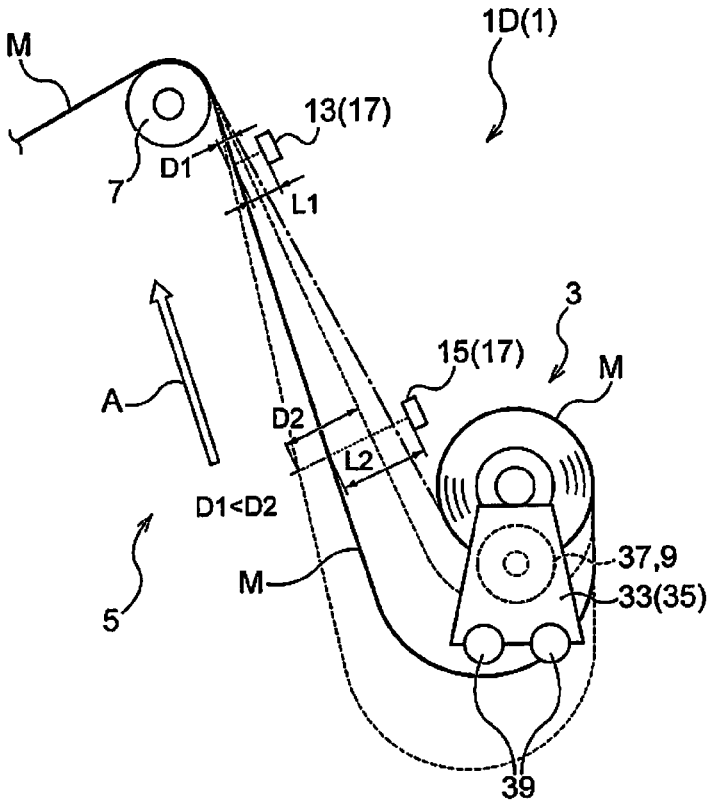

FIGS. 6A and 6B

The liquid discharge device 1D(1) of embodiment 4 is the same as the liquid discharge device 1B of embodiment 2 described previously for the constitution other than the only difference which is the arrangement of the second sensor 15.

Therefore, here, a description of the same constitution as that of embodiment 2 will be omitted, and the description will be focused on the constitutions unique to embodiment 4.

Specifically, with this embodiment 4, the arrangement of the sensor pair 17 for which only one set is provided is different from embodiment 2, whereby the first sensor 13 and the second sensor 15 are arranged at positions skewed in the reel-out direction A of the media M.

In specific terms, as shown in FIGS. 6A and 6B, an arrangement of the sensor pair 17 is used for which the second sensor 15 is positioned further to the upstream side toward the media reel-out unit 3 side than the position of the first sensor 13.

Then, with the liquid discharge device 1D of this embodiment 4 constituted in this way as well, it is possible to enjoy the same operation and effects as those of the liquid discharge device 1B of embodiment 2 described previously and the liquid discharge device 1C of embodiment 3 described previously.

Furthermore, with this embodiment 4, when using the first sensor 13 and the second sensor 15 as slack sensors, measurement of the slack volume W of the media M is performed at positions of two points skewed in both directions of the width direction B and the reel-out direction A of the media M. Therefore, the measurement precision of the media M slack volume W is improved by comparing the measurement values of the positions of two points.

Also, with this embodiment, the displacement volume D accompanying slack of the media M for the second sensor 15 provided at a position further toward the media reel-out unit 3 than the first sensor 13 provided at the position toward the first guide roller 7 becomes larger as shown in FIG. 6B (D1<D2). By doing this, the measurement precision of the media M slack volume W is improved.

Also, when using the first sensor 13 and the second sensor 15 as the meandering sensor, it is possible to perform ascertaining of both the presence or absence of meandering and the meandering direction using the measurement values of the positions of two points skewed in both directions of the width direction B and the reel-out direction A of the media M.

Embodiment 5

FIG. 7

The liquid discharge device 1E(1) of this embodiment 5 is the same as the liquid discharge device 1A of embodiment 1 described previously for the constitution other than the only difference which is that it is constituted such that the first sensor 13 and the second sensor 15 can move.

Therefore, here, a description of the same constitution as that of embodiment 1 will be omitted, and the description will be focused on the constitutions unique to embodiment 5.

Figure 7:
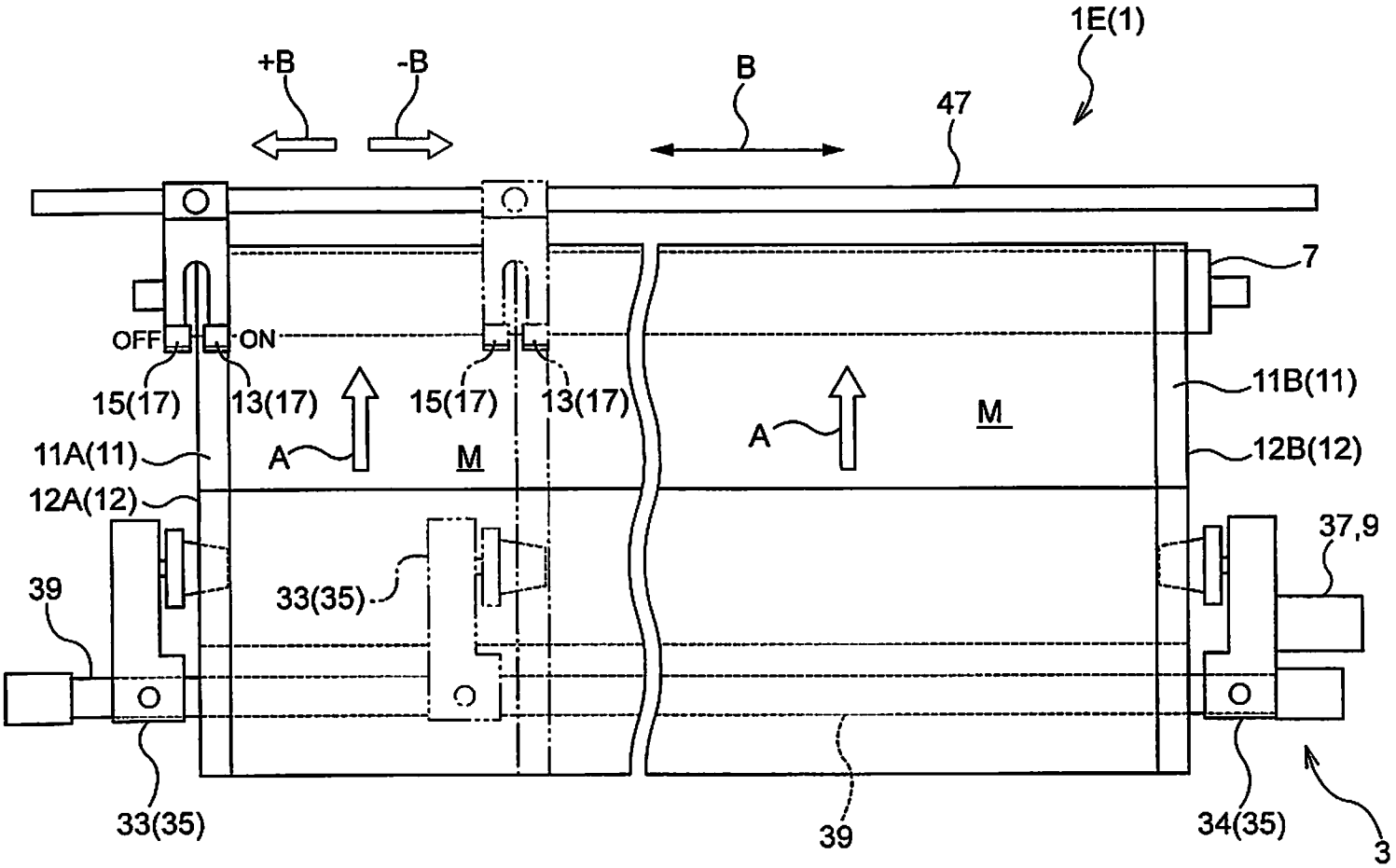
FIG. 7 is a front view showing the circumferential side of the media reel-out unit of the liquid discharge device of embodiment 5 of the present invention.

Specifically, with this embodiment 5, the first sensor 13 and the second sensor 15 for which only one set is provided is constituted so as to be able to move in the width direction B of the media M according to the width direction of the media M. As a mode for making it possible for the first sensor 13 and the second sensor 15 to move, the first sensor 13 and the second sensor 15 are supported on a guide member 47 that extends along the width direction B as shown in FIG. 7, and these can be moved manually, or the first sensor 13 and the second sensor 15 can be automatically moved by combining a motor and a rack and pinion mechanism or the like.

Then, with the liquid discharge device 1E of this embodiment 5 constituted in this way as well, it is possible to enjoy the same operation and effects as those of the liquid discharge device 1A of embodiment 1 described previously.

Furthermore, with this embodiment 5, it is possible to adjust the position of the first sensor 13 and the second sensor 15 according to the width dimension of the used media M, so in a state applied to various media M of different width dimensions, it is possible to realize maintaining of a suitable slack volume W and suppression of meandering of the media during conveying of the media M, while reducing the number of sensors that are needed.

Also, with this embodiment 5, because the first sensor 13 and the second sensor 15 were separated away from the media reel-out unit 3 and made to be able to move independently, it is possible to provide the first sensor 13 and the second sensor 15 at a suitable position without considering the constitution of the media reel-out unit 3 or the positional relationship or the like, and to increase the degree of freedom for arranging.

Embodiment 6

FIG. 8

The liquid discharge device 1F(1) of embodiment 6 is the same as the liquid discharge device 1A of embodiment 1 described previously for the constitution other than the only difference which is that the first sensor 13 and the second sensor 15 are able to move in coordination with the movement of the movable holder 33.

Therefore, here, a description of the same constitution as that of embodiment 1 will be omitted, and the description will be focused on the constitutions unique to embodiment 6.

Figure 8:
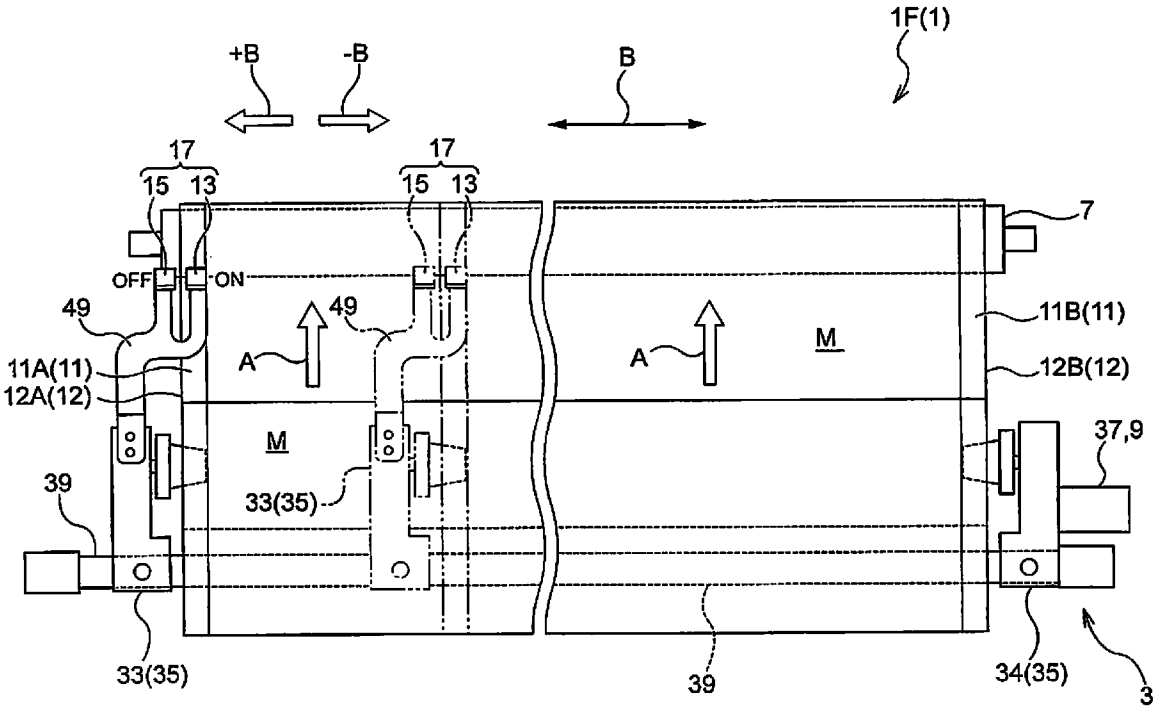
FIG. 8 is a front view showing the circumferential side of the media reel-out unit of the liquid discharge device of embodiment 6 of the present invention.

Specifically, with this embodiment 6, the first sensor 13 and the second sensor 15 for which only one set is provided are constituted so as to be able to move in the width direction B in coordination with the movement of the movable holder 3 of the media reel-out unit 3. As a mode for having the first sensor 13 and the second sensor 15 work in coordination with the movement of the movable holder 33, as shown in FIG. 8, it is possible to support the first sensor 13 and the second sensor 15 on a bracket 49 attached to the movable holder 33, or possible to transmit the movement of the movable holder 33 to the first sensor 13 and the second sensor 15 via a wire, a linking rod or the like.

Then, with the liquid discharge device 1F of this embodiment 6 constituted in this way as well, it is possible to enjoy the same operation and effects as those of the liquid discharge device 1A of embodiment 1 described previously.

Furthermore, with this embodiment 6, the same as with embodiment 5, it is possible to adjust the position of the first sensor 13 and the second sensor 15 according to the width dimension of the used media M, so in a state applied to various media M of different width dimensions, it is possible to realize maintaining of a suitable slack volume W and suppression of meandering of the media during conveying of the media M, while reducing the number of sensors that are needed.

Also, with this embodiment 6, by executing position adjustment of the movable holder 33 performed to match to the width dimension of the media M when setting the media M in the media reel-out unit 3, it is possible to automatically adjust the position of the first sensor 13 and the second sensor 15 to the optimal position, so this position adjustment work is easier.

Embodiment 7

FIG. 9 and FIG. 10

The media reel-out method of the present invention is a method of reeling out the media M while adjusting the reel-out volume of the media M being reeled out from the media reel-out unit 3 based on changes in the slack volume W of the media M and on the presence or absence of meandering of the media M.

In specific terms, when adjusting the reel-out volume when media M rolled into roll form is reeled out from the media reel-out unit 3 based on changes in the slack volume W of the media M, the slack volume W of the media M is found by measuring the distance between the media M and the first sensor 13 using the first sensor 13 arranged at a position facing at least one edge part 11A in the width direction B of the media M, and a determination is made of the presence or absence of meandering of the media M by the sensor pair 17 which is the sensor pair 17 arranged separated in the width direction B of the media M, and which is equipped with the first sensor 13 which is one item forming that pair, and equipped with the second sensor 15 which is the other.

Then, setting of the reel-out volume of the media M and switching between continuing and stopping of reel-out of the media M are performed based on the presence or absence of meandering of the media M determined by changes in the found slack volume W of the media M.

This embodiment 7 is (1) setting of the media reel-out volume and (2) switching between continuing and stopping of media reel-out that are executed when using the liquid discharge device 1A of embodiment 1 described previously. We will give a specific description focusing on the following two points.

Figure 9:
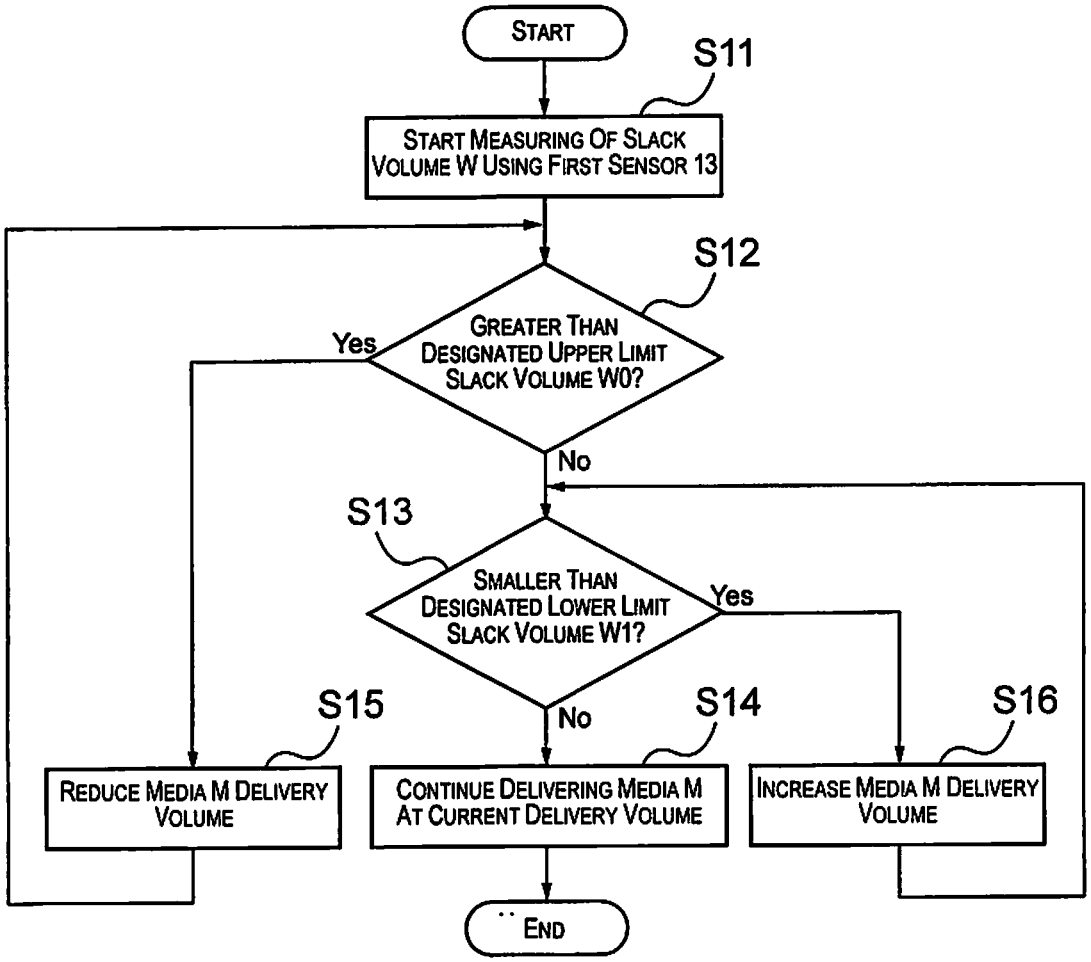
FIG. 9 is a flow chart showing the adjustment flow of the media reel-out volume with the media reel-out mode of embodiment 7 of the present invention.

(1) Setting the Media Reel-Out Volume (FIG. 9)

With this embodiment 7, using the first sensor 13 arranged at a position facing one edge part 11A in the width direction B of the media M, the distance L between that media M and the first sensor 13 is measured and the slack volume W of that media M is found, and the reel-out volume of the media M is set based on changes in that slack volume W.

In specific terms, as shown in FIG. 9, at step S11, measurement of the slack volume W of the media M is started by the first sensor 13, and at step S12, a determination is performed of whether or not the slack volume W of the media M is greater than the upper limit slack volume W0 set in advance.

When it is determined to be smaller than the designated upper limit slack volume W0, the process moves to step S13, and a determination is made for whether or not it is smaller than a designated lower limit slack volume W1. When it is determined at step S13 that it is grater then the designated lower level slack volume W1, the slack volume W of the media M is kept in a suitable range, so the process moves to step S14, and reel-out of the media M continues at the current reel-out volume.

Also, when it is determined at step S12 that the slack volume W of the media M is greater than the designated upper limit slack volume W0, the process moves to step S15, and the reel-out volume of the media M is reduced so that the slack volume W of the media M is positioned in an appropriate range.

Also, when the slack volume W of the media M is determined at step S13 to be smaller than the designated lower limit slack volume W1, the process moves to step S16, the reel-out volume of the media M is increased, and the slack volume W of the media M is positioned in an appropriate range.

Figure 10:
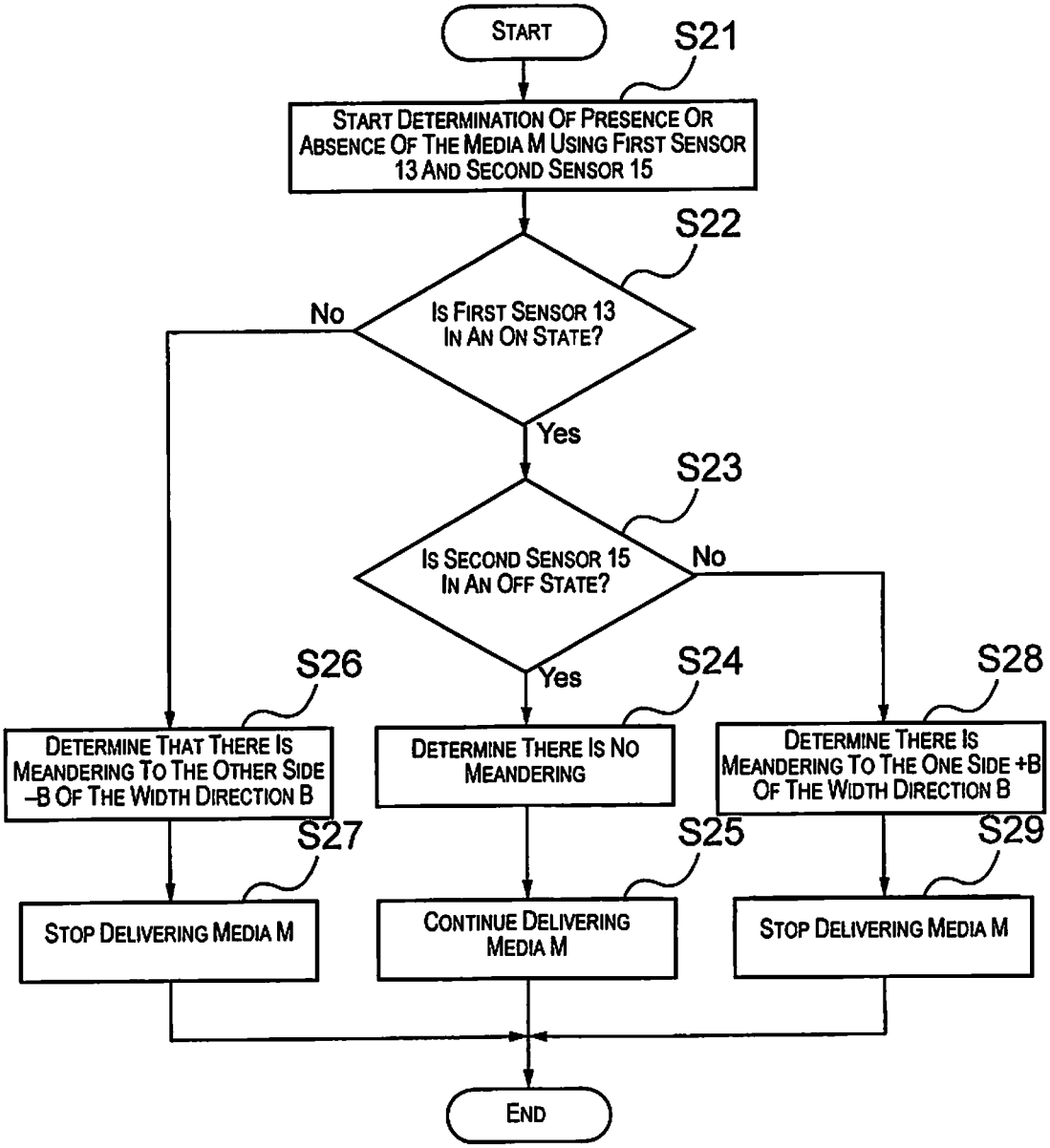
FIG. 10 is a flow chart showing the switching flow between continuing and stopping of media reel-out with the media reel-out method of embodiment 7 of the present invention.

(2) Switching Between Continuing and Stopping of Reel-Out of the Media (FIG. 10)

With this embodiment 7, a determination is made of the presence or absence of meandering of the media M using the first sensor 13 which is arranged at a position facing one edge part 11A in the width direction B of the media M, and the second sensor 15 arranged at the outside of the one edge part 11A, and switching is done between continuing and stopping reel-out of the media M based on that determination.

In specific terms, at step S21 shown in FIG. 10, discrimination of the presence or absence of the media M is started using the first sensor 13 and the second sensor 15, and at step S22, a determination is made of whether or not the first sensor 13 is in the On state.

When it is determined that the first sensor 13 is in the On state, the process moves to step S23, and a determination is made of whether or not the second sensor 15 is in the Off state. When it is determined at step S23 that the second sensor 15 is in the Off state, the process moves to step S24, a determination is made that the media M is not meandering, the process moves to step S25, and reel-out of the media M continues.

Also, at step S22, when it is determined that the first sensor 13 is in an Off state, the process moves to step S26, it is determined that there is meandering to the other side −B of the width direction B of the media M, the process moves to step S27, and reel-out of the media M stops. In this case, the user is notified of the presence or absence of meandering of the media M and the meandering direction (−B) using an appropriate notification means.

Also, at step S23, when it is determined that the second sensor 15 is in an On state, the process moves to step S28, it is determined that there is meandering to the other side +B of the width direction B of the media M, the process moves to step S29, and reel-out of the media M stops. In this case, the user is notified of the presence or absence of the meandering of the media M and the meandering direction (+B) using an appropriate notification means.

Then, with the media reel-out method of the present invention constituted in this way, it is possible to realize the measurement of the slack volume W of the media M and the determination of the presence or absence of meandering of the media M using one set of the sensor pair 17 equipped with the first sensor 13 and the second sensor 15 arranged at designated positions, so it is possible to realize maintaining of a suitable slack volume and suppression of meandering of the media during conveying of the media, while reducing the number of sensors that are required.

Other Embodiments

The liquid discharge device 1 and the media M reel-out method of the present invention basically have the constitution as described above, but it is of course also possible to change, omit or the like partial constitutions within a range that does not stray from the gist of the invention of this application.

For example, aside from providing one set for the sensor pair 17 equipped with the first sensor 13 and the second sensor 15, it is also possible to provide a plurality of sets, such as providing one set each at both sides of one side +B and the other side −B of the width direction B of the media M.

Also, as another constitution corresponding to media M with different width dimensions, with a plurality of sets arranged in advance in the width direction B of the media M for the sensor pair 17, it is possible to select and use the sensor pair 17 to use according to the width dimension of the used media M.

Also, the reel-out method of the media M of the present invention is not limited to a case of using the liquid discharge device 1A of embodiment 1 described previously, and it is also possible to use a case of using the liquid discharge device 1 of various constitutions of the present invention including embodiments 2 through 6 described previously.

For example, when using the liquid discharge device 1B of embodiment 2, measurement of the slack volume W of the media M is performed by both the first sensor 13 and the second sensor 15, so the slack volume W measured by the first sensor 13 and the second sensor 15 are compared, and after calculating the comprehensively determined current media M slack volume W, a process like that shown in FIG. 9 is performed and the reel-out volume of the media M is set.

Also, with embodiment 2, the arrangement of the sensor pair 17 is different from the case of embodiment 1, so processing is executed based on the arrangement of the sensor pair 17 of embodiment 2. In specific terms, when the first sensor 13 is in an On state and the second sensor 15 is in an Off state as shown in FIG. 4A, it is determined that the media M is meandering to the one side +B of the width direction B, when the first sensor 13 is in an Off state and the second sensor 15 is in an On state as shown in FIG. 4B, it is determined that the media M is meandering to the other side −B of the width direction B of the media M, and when both the first sensor 13 and the second sensor 15 are in an On state as shown in FIG. 4C, it is determined that meandering has not occurred with the media M.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustrationly, and not for the purpose of limiting the invention as defined by the appended claims and their equivalents.

What is claimed is:

1. A liquid discharge device comprising:

a media reel-out unit configured and arranged to reel out media;

a reel-out volume adjustment unit configured and arranged to adjust a reel-out volume of the media reeled out from the media reel-out unit based on change in a slack volume of the media at a position downstream from the media reel-out unit;

a first sensor arranged at a position facing at least one edge part in a media width direction of the media; and a second sensor arranged spaced apart from the first sensor in the media width direction, wherein the slack volume of the media is ascertained using sensing information of the first sensor, and presence or absence of meandering of the media is ascertained using sensing information of the first sensor and the second sensor.

2. The liquid discharge device according to claim 1, wherein the media reel-out volume is adjusted based on the slack volume, and a meandering countermeasure process is executed based on the meandering information indicative of presence of meandering.

3. The liquid discharge device according to claim 1, wherein the first sensor is arranged at a position facing the one edge part in the media width direction of the media, and the second sensor is arranged at an outside of the one edge part in the media width direction of the media.

4. The liquid discharge device according to claim 1, wherein the first sensor is arranged at a position facing the one edge part in the media width direction of the media, and the second sensor is arranged at a position facing the other edge part in the media width direction of the media.

5. The liquid discharge device according to claim 3, wherein the first sensor and the second sensor are arranged at positions skewed in a media reel-out direction.

6. The liquid discharge device according to claim 4, wherein the first sensor and the second sensor are arranged at positions skewed in a media reel-out direction.

7. The liquid discharge device according to claim 1, wherein positions of the first sensor and the second sensor are variable in the media width direction according to a media width dimension.

8. The liquid discharge device according to claim 7, wherein the first sensor and the second sensor move in the media width direction in coordination with a position of a movable holder of the media reel-out unit.

9. The liquid discharge device according to claim 3, further comprising a control unit that performs the following determinations (1) to (3) based on the sensing information of the first sensor and the second sensor, (1) determination that when both the first sensor and the second sensor are in an On state, there is meandering to one side by the media, (2) determination that when both the first sensor and the second sensor are in an Off state, there is meandering to the other side by the media, or (3) determination that when the first sensor is in the On state and the second sensor is in the Off state, proper reel-out of the media is executed.

10. The liquid discharge device according to claim 4, further comprising a control unit that performs the following determinations (1) to (3) based on the sensing information of the first sensor and the second sensor, (1) determination that with the reel-out control unit, when the first sensor is in the On state and the second sensor is in the Off state, there is meandering to one side by the media, (2) determination that when the first sensor is in an Off state and the second sensor is in an On state, there is meandering to the other side by the media, or (3) determination that when the first sensor and the second sensor are both in the On state, proper reel-out of the media is executed.

11. A media reel-out method adapted to adjust a reel-out volume when reeling media out from a media reel-out unit based on change in a slack volume of the media, the media reel-out method comprising:

detecting the slack volume of the media by measuring a distance between the media and a first sensor using the first sensor arranged at a position facing at least one edge part in a media width direction of the media; and determining presence or absence of meandering of the media using the first sensor and a second sensor spaced apart from the first sensor in the media width direction.

* * * * *